US009807535B2

(12) United States Patent
Bostick et al.

(10) Patent No.: US 9,807,535 B2
(45) Date of Patent: Oct. 31, 2017

(54) THREE DIMENSIONAL AUDIO SPEAKER ARRAY

(71) Applicant: INTERNATIONAL BUSINESS MACHINES CORPORATION, Armonk, NY (US)

(72) Inventors: James E. Bostick, Cedar Park, TX (US); John M. Ganci, Jr., Cary, NC (US); Martin G. Keen, Cary, NC (US); David B. Lection, Raleigh, NC (US); Sarbajit K. Rakshit, Kolkata (IN)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 39 days.

(21) Appl. No.: 14/927,612

(22) Filed: Oct. 30, 2015

(65) Prior Publication Data

US 2017/0127209 A1 May 4, 2017

(51) Int. Cl.
*H04R 5/00* (2006.01)
*H04S 7/00* (2006.01)
(Continued)

(52) U.S. Cl.
CPC ..... *H04S 7/301* (2013.01); *H04R 5/02* (2013.01); *H04R 5/04* (2013.01); *H04S 3/008* (2013.01); *H04S 2400/11* (2013.01)

(58) Field of Classification Search
CPC .. H04R 5/02; H04R 5/04; H04S 7/301; H04S 2400/11; H04S 3/008
See application file for complete search history.

(56) References Cited

U.S. PATENT DOCUMENTS 6,215,883 B1 4/2001 Leonarz
2005/0271230 A1 12/2005 Sasaki
(Continued)

FOREIGN PATENT DOCUMENTS

CN 102857851 A 1/2013
EP 1718105 A2 11/2006
(Continued)

OTHER PUBLICATIONS

Martin, Trent, "Acoustically Transparent Screen Home Design Photos", Houzz, http://www.houzz.com/photos/query/Acoustically-transparent-screen, Accessed Aug. 6, 2015, 5 pages.
(Continued)

*Primary Examiner* — Muhammad N Edun
(74) *Attorney, Agent, or Firm* — Lisa J. Ulrich; Andrew M. Calderon; Roberts Mlotkowski Safran Cole & Calderon, P.C.

(57) ABSTRACT

Systems and methods for audio control are disclosed. A computer-implemented method includes: determining, by a computing device, an X-Y-Z location of a sound associated with an image object projected on a screen; determining, by a computing device, a front speaker of a front speaker array based on an X-Y coordinate of the X-Y-Z location; determining, by a computing device, at least one side speaker of a left speaker array and a right speaker array based on a Z coordinate of the X-Y-Z location, wherein the left speaker array and the right speaker array are on a side of the screen opposite the front speaker array; and causing, by a computing device, the front speaker and the at least one side speaker to emit the sound.

19 Claims, 5 Drawing Sheets

(51) Int. Cl.

| | |
|---|---|
| ***H04S 3/00*** | (2006.01) |
| ***H04R 5/04*** | (2006.01) |
| ***H04R 5/02*** | (2006.01) |

(56) References Cited

U.S. PATENT DOCUMENTS

| | | | | |
|---|---|---|---|---|
| 2006/0020880 | A1 | 1/2006 | Chen | |
| 2007/0025703 | A1 | 2/2007 | Horie | |
| 2011/0007915 | A1 | 1/2011 | Park | |
| 2013/0121515 | A1 | 5/2013 | Hooley et al. | |
| 2013/0163952 | A1 | 6/2013 | Ni et al. | |
| 2014/0133683 | A1* | 5/2014 | Robinson ..... | H04S 3/008 381/303 |
| 2014/0241558 | A1 | 8/2014 | Yliaho et al. | |

FOREIGN PATENT DOCUMENTS

| | | | |
|---|---|---|---|
| EP | 2268012 | A2 | 12/2010 |
| WO | 2004054314 | A1 | 6/2004 |

OTHER PUBLICATIONS

Archer, Robert, "The Ins and Outs of Acoustically Transparent Screens", CE Pro, http://www.cepro.com/article/the_ins_and_outs_of_acoustically_transparent_screens/, Nov. 26, 2014, 6 pages.

Specification "Three Dimensional Audio Speaker Array" and Drawings in U.S. Appl. No. 15/686,458 filed Aug. 25, 2017, 26 pages.

* cited by examiner

THREE DIMENSIONAL AUDIO SPEAKER ARRAY

BACKGROUND

The present invention relates generally to audio systems and, more particularly, to methods and systems for coordinating sound production with video object location.

The source of generated sound is an important component of the user experience when watching a movie. Different types of sound effects can be created with multiple speakers installed at different locations of a room. For example, existing audio technologies, such as surround sound systems, attempt to place the sound generated by objects appearing on screen in the room. For example in an action movie a helicopter may be heard flying overheard, the roar of the engines of a fast car moves from left-to-right across the room and so forth. This helps give the illusion that the action is taking place in the room where the visuals are playing.

A common surround sound system is the 5.1 configuration that includes five channels: left screen, center screen, right screen, left surround, and right surround. A separate channel for a subwoofer may be provided for low-frequency effects. The 7.1 surround sound configuration is similar to the 5.1 configuration, with the addition that the left surround and right surround channels are split into four zones: left side surround, right side surround, left rear surround, and right rear surround. In this manner, the 7.1 surround configuration has seven channels, and an optional additional channel for a subwoofer. A more recent development is the 22.2 surround sound configuration including twenty-four speaker channels, which may be used to drive speakers arranged in three layers. An upper speaker layer is driven by nine channels, a middle speaker layer is driven by ten channels, and a lower speaker layer is driven by five channels, two of which are for subwoofers.

These existing surround sound systems use a central channel that drives a speaker that is vertically aligned with the center of the display screen, but not behind the display screen. This central channel cannot, with any precision, track the sound of an object so that the audio emits from the exact location of where that object is positioned on the display screen. Therefore, none of these systems produce a sound at a precise location behind the display screen corresponding to the displayed video object associated with the sound.

SUMMARY

In an aspect of the invention, a computer-implemented method includes: determining, by a computing device, an X-Y-Z location of a sound associated with an image object projected on a screen; determining, by a computing device, a front speaker of a front speaker array based on an X-Y coordinate of the X-Y-Z location; determining, by a computing device, at least one side speaker of a left speaker array and a right speaker array based on a Z coordinate of the X-Y-Z location, wherein the left speaker array and the right speaker array are on a side of the screen opposite the front speaker array; and causing, by a computing device, the front speaker and the at least one side speaker to emit the sound.

In another aspect of the invention, there is a system including: an acoustically transparent screen; a projector configured to project video onto the screen; a front speaker array behind the screen; a left speaker array extending orthogonal to the front speaker array and the screen; a right speaker array extending orthogonal to the front speaker array and the screen; and a sound processor that is configured to cause a speaker in the front speaker array, a speaker in the left speaker array, and a speaker in the right speaker array to emit a sound based on a location of an image object projected on the screen by the projector.

In another aspect of the invention, there is a computer program product for audio control. The computer program product includes a computer readable storage medium having program instructions embodied therewith. The program instructions are executable by a computing device to cause the computing device to: receive a source signal; determine a location of a sound associated with an image object projected on a screen based on the source signal; determine at least one speaker to play the sound; and transmit a signal to the at least one speaker to play the sound. The determining the location of the sound comprises one of: determining an X-Y-Z location of the sound by decoding data encoded in the source signal; and determining an X-Y location of a sound associated with a projected image object by: analyzing a video component of a source signal, using image analysis, to identify a predefined object; and analyzing an audio component of the source signal to identify a sound associated with the identified object.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

Figure 1:
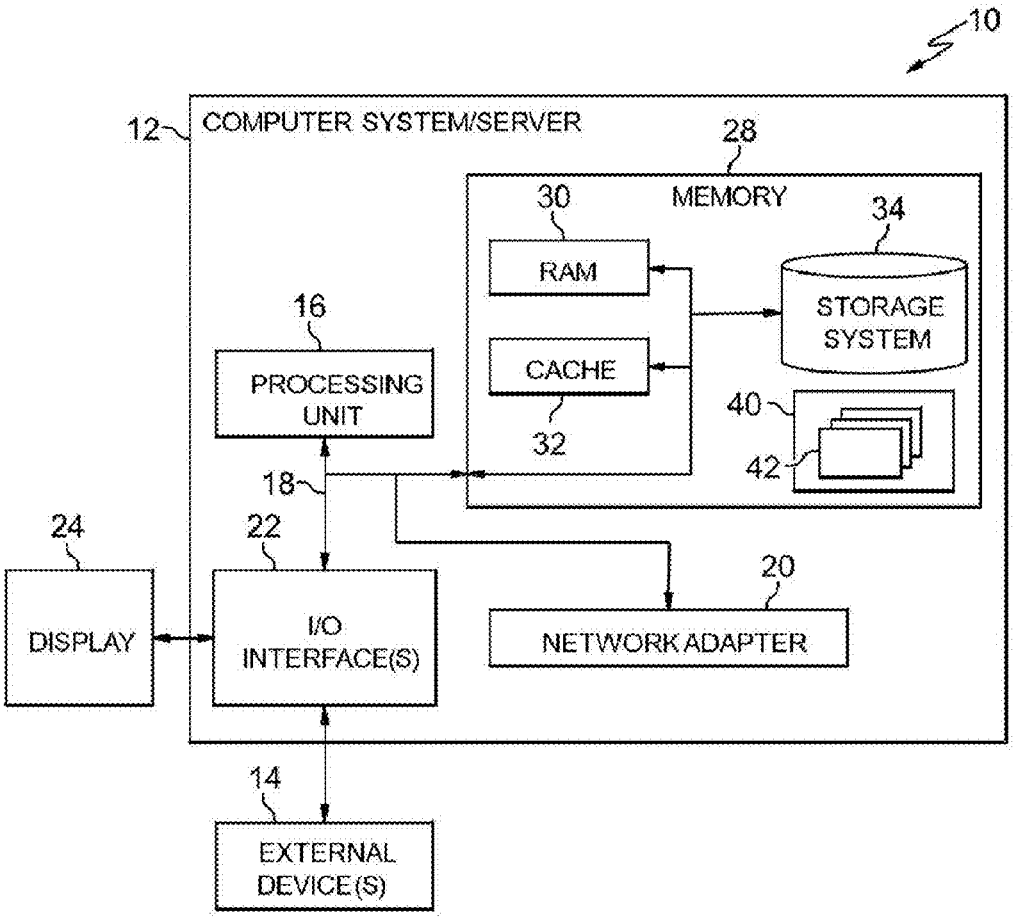
FIG. 1 depicts a computing infrastructure according to an embodiment of the present invention.

The present invention relates generally to audio systems and, more particularly, to methods and systems for coordinating sound production with video object location. In accordance with aspects of the invention, there is a system for acoustically transparent displays that broadcast sounds from the precise on-screen location from where a given object emitted the sound. In embodiments, the system makes use of a speaker array in matrix format positioned behind the projection screen. In implementations, the system performs the location-specific sound emission for video streams that have been encoded with such information, or performs real-time analysis to track the location of an object and project the sound from that object is it moves across the screen. In an embodiment, sounds are emitted from the appropriate Z-axis position from within a room.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the flowchart illustrations, and combinations of blocks in the flowchart illustrations, can be implemented by special purpose hardware-based systems that perform the specified functions or acts or carry out combinations of special purpose hardware and computer instructions.

Referring now to FIG. 1, a schematic of an example of a computing infrastructure is shown. Computing infrastructure 10 is only one example of a suitable computing infrastructure and is not intended to suggest any limitation as to the scope of use or functionality of embodiments of the invention described herein. Regardless, computing infrastructure 10 is capable of being implemented and/or performing any of the functionality set forth hereinabove.

In computing infrastructure 10 there is a computer system (or server) 12, which is operational with numerous other general purpose or special purpose computing system environments or configurations. Examples of well-known computing systems, environments, and/or configurations that may be suitable for use with computer system 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system 12 may be described in the general context of computer system executable instructions, such as program modules, being executed by a computer system. Generally, program modules may include routines, programs, objects, components, logic, data structures, and so on that perform particular tasks or implement particular abstract data types. Computer system 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system 12 in computing infrastructure 10 is shown in the form of a general-purpose computing device. The components of computer system 12 may include, but are not limited to, one or more processors or processing units (e.g., CPU) 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system 12 typically includes a variety of computer system readable media. Such media may be any available media that is accessible by computer system 12, and it includes both volatile and non-volatile media, removable and non-removable media.

System memory 28 can include computer system readable media in the form of volatile memory, such as random access memory (RAM) 30 and/or cache memory 32. Computer system 12 may further include other removable/non-removable, volatile/non-volatile computer system storage media. By way of example only, storage system 34 can be provided for reading from and writing to a nonremovable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system 12 may also communicate with one or more external devices 14 such as a keyboard, a pointing device, a display 24, etc.; one or more devices that enable a user to interact with computer system 12; and/or any devices (e.g., network card, modem, etc.) that enable computer system 12 to communicate with one or more other computing devices. Such communication can occur via Input/Output (I/O) interfaces 22. Still yet, computer system 12 can communicate with one or more networks such as a local area network (LAN), a general wide area network (WAN), and/or a public network (e.g., the Internet) via network adapter 20. As depicted, network adapter 20 communicates with the other components of computer system 12 via bus 18. It should be understood that although not shown, other hardware and/or software components could be used in conjunction with computer system 12. Examples, include, but are not limited to: microcode, device drivers, redundant processing units, external disk drive arrays, RAID systems, tape drives, and data archival storage systems, etc.

Figure 2:
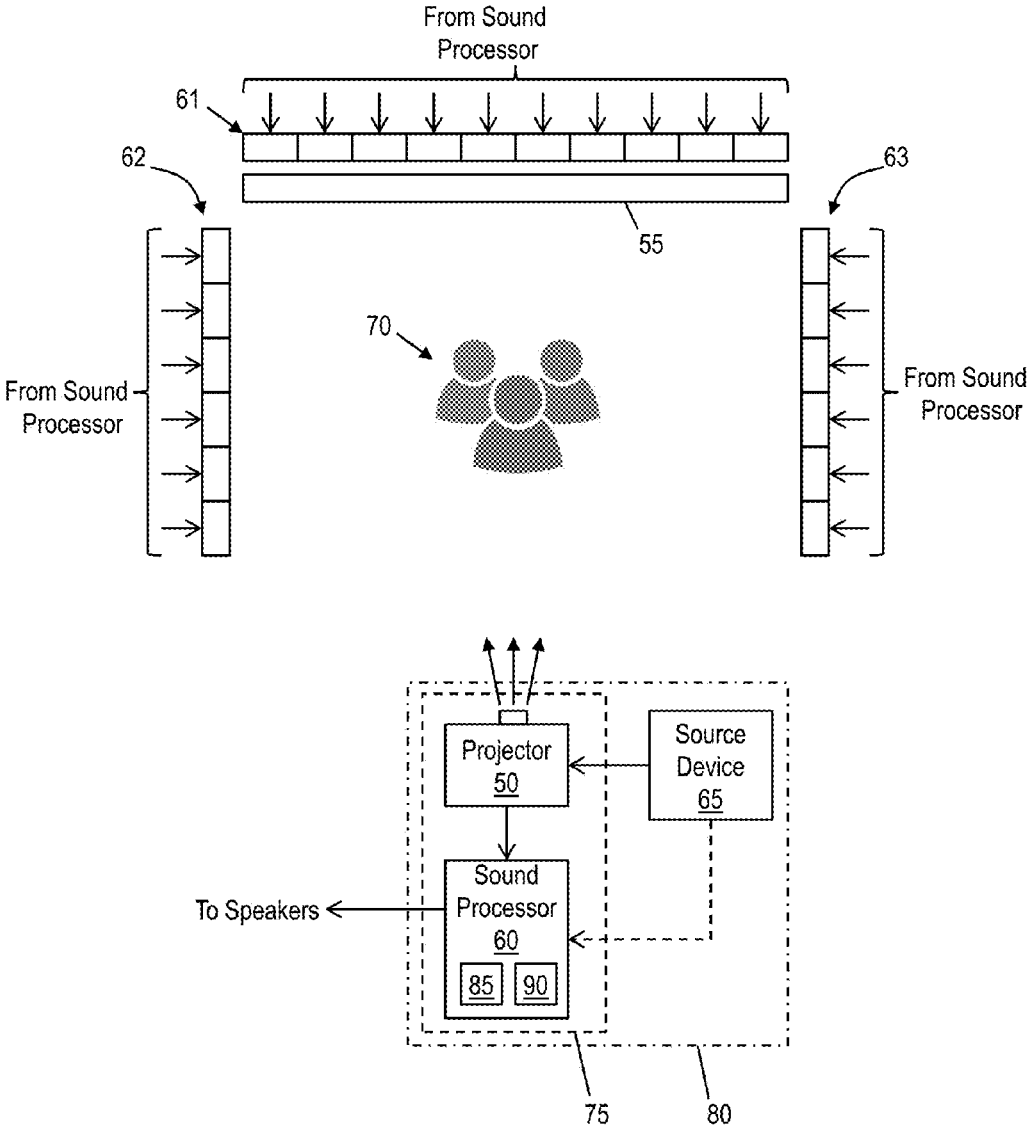
FIG. 2 shows an exemplary environment in accordance with aspects of the invention.

FIG. 2 shows an exemplary environment in accordance with aspects of the invention. The environment includes a video projector 50 that projects video content, e.g., a movie, onto a screen 55. The environment also includes a sound processor 60 that provides signals for driving audio speakers in speaker arrays 61, 62, 63. The environment also includes a source device 65 that provides a source signal. The source device 65 may be, for example, a set top box, DVD player, Blu-ray player, or other similar device that provides the source signal to the projector 50 and/or the sound processor 60. The source signal may include an audio component and a video component. In one exemplary implementation, the source device 65 is connected to and provides the source signal to the projector 50, which in turn is connected to and provides the source signal to the sound processor 60. In another exemplary implementation, the source device 65 is connected to both the projector 50 and the sound processor 60 and provides a source signal to each device. When the components are separate devices, they may be connected by wired connection, either directly connected to one another or connected via a network such as a LAN. Alternatively, they may communicate by wireless communication, such as through a WiFi network.

In embodiments, the projector 50 projects a video image onto the screen 55 based on the video component of the source signal, and the audio processor provides audio signals to the speakers of the arrays 61-63 based on the audio component of the source signal. In this manner, the environment may be used to play coordinated audio and video content, e.g., such as a movie with sound effects, for one or more users 70.

The projector 50, sound processor 60, and source device 65 may be separate devices as indicated by the solid lines in FIG. 2. Alternatively, two or more of the projector 50, sound processor 60, and source device 65 may be integrated as a single device. For example, the projector 50 and the sound processor 60 may be integrated into a single device, as depicted by dashed line 75. Alternatively, the projector 50, sound processor 60, and source device 65 may be integrated into a single device, as depicted by dash-dot line 80. The projector 50 may comprise a conventional video projector, such as an LCD, LED, or DLP projector. Further, one or more power amplifiers (not shown) may be connected between the sound processor 60 and the speakers to provide sufficient signal strength to drive the speakers.

In embodiments, the screen 55 is an acoustically transparent projection screen that is configured to provide a surface on which video images may be visibly projected and which allows audio to pass through the screen with negligible attenuation and no comb filtering or lobing. In this manner, the front speaker array 61 may be positioned directly behind the screen 55 and emit sounds through the screen 55 to the users 70 on the other side.

According to aspects of the invention, the front speaker array 61 comprises a matrix of individual speakers arranged in rows and columns directly behind the screen, as described in greater detail with respect to FIG. 3. Further, each of the left speaker array 62 and the right speaker array 63 comprises plural individual speakers that extend into the room in a direction orthogonal to the screen 55, as described in greater detail with respect to FIG. 4.

Referring back to FIG. 2, in accordance with aspects of the invention, the sound processor 60 comprises a computing device such as computer system 12 of FIG. 1. The sound processor 60 may include at least one of a decoder module 85 and an analyzer module 90, each of which may be a program module such as program module 42 of FIG. 1.

In embodiments, the decoder module 85 is configured to map portions of the audio component of the source signal to individual speakers in the speaker arrays 61-63. For example, the audio component of the source signal (from the source device 65) may be encoded with data that defines a location of a sound within a two-dimensional area or a three-dimensional space, and the decoder module 85 interprets the encoded data and provides appropriate audio signals to individual speakers in the speaker arrays 61-63. For example, the encoded data may define an X-Y coordinate or an X-Y-Z coordinate associated with a portion of the audio signal (e.g., a particular sound), and the decoder module 85 may be configured to map the coordinate to one or more of the individual speakers in the speaker arrays 61-63. The X-Y coordinates may correspond to locations in a speaker array 61 behind the screen 55 (as shown in FIG. 3), and the Z coordinates may correspond to a depth direction orthogonal to the screen 55 (as shown in FIG. 4). The encoding of the audio data may be performed using virtual reality modeling language (VRML) or similar technologies.

In embodiments, the analyzer module 90 is configured to analyze portions of the audio component and video component of the source signal to determine appropriate audio signals for individual speakers in the speaker arrays 61-63. In aspects, the analyzer module 90 is configured to use image analysis to track specific objects that are projected onto the screen 55 (e.g., in the video projection) and their corresponding sounds. For example, in a soccer game, image analysis is used to track the projected image of a soccer ball, and audio analysis is used to isolate the sound of a soccer ball being kicked. Together, the image analysis (the image of the ball) and audio analysis (the sound of the ball) allow an object to be tracked on-screen, and for the sound of the object to be emitted from an individual speaker in the speaker arrays 61-63 that corresponds to the position of that object (the ball) on the screen 55. In embodiments, the analyzer module 90 is configured to analyze the source signal in this manner and provide audio signals to individual speakers in the speaker arrays 61-63. The analyzer module 90 may reside in the sound processor 60, the source device 65, or in a stand-alone device such as a video/audio analysis processor.

Figure 3A:
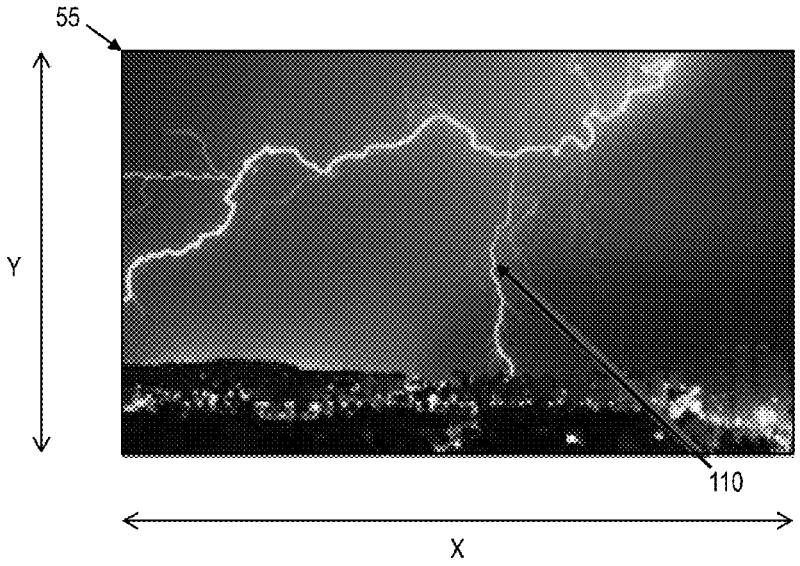
FIGS. 3A, 3B, and 4 illustrate exemplary implementations in accordance with aspects of the invention.
Figure 3B:
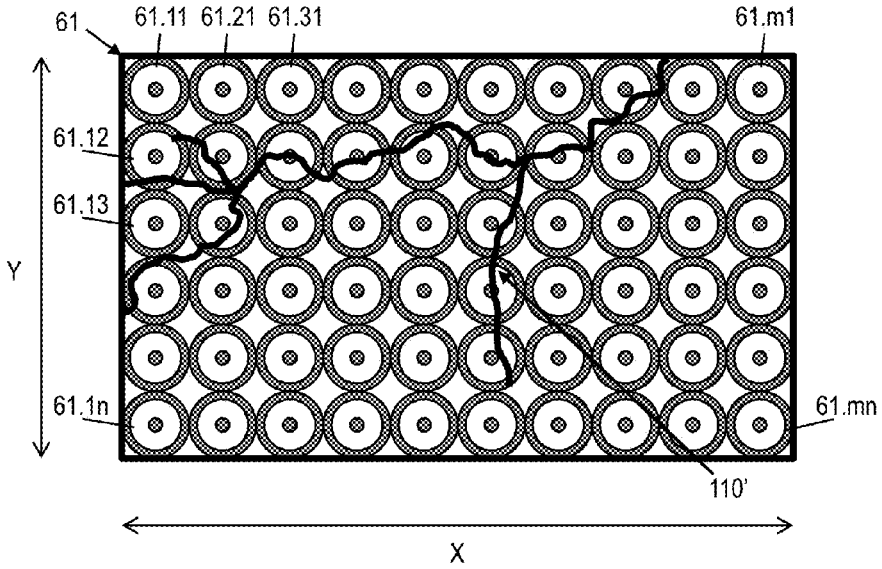
Figure 4:
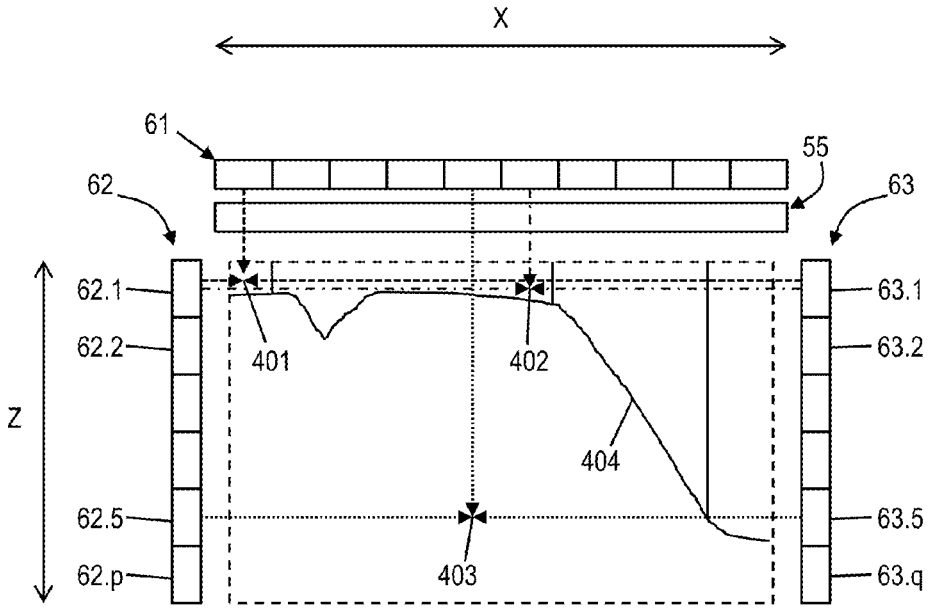

FIG. 3A shows an exemplary image object 110 projected onto the screen 55, and FIG. 3B shows an exemplary implementation of the front speaker array 61. The screen 55 and the front speaker array 61 are shown separately in FIGS. 3A and 3B for illustrative purposes, but it is understood that the front speaker array 61 is directly behind the screen 55 as shown and described with respect to FIG. 2. The front speaker array 61 in FIG. 3B includes "m" vertical columns and "n" horizontal rows of speakers (e.g., 61.11, . . . , 61.*mn*), where "m" and "n" are any desired integer values. In embodiments, the dimensions of the front speaker array 61 match the dimensions of the video display portion of the screen 55. In aspects, each individual speaker in the front speaker array 61 is controllable by the sound processor 60 independently of the other speakers in the array. The speakers of the front speaker array 61 are not visible to the users 70 when video images are projected onto the screen 55.

With continued reference to FIGS. 3A and 3B, in aspects of the invention, the system maps sources of sound with their location on the screen 55, either by decoding location data that is included in the source signal or by performing real time image and audio analysis as described herein. In embodiments, as shown in FIGS. 3A and 3B, the screen 55 and the front speaker array 61 have the same dimensions in the X direction and the Y direction, such that a one-to-one mapping may be achieved for the X-Y location of an object in the image on the screen 55 and one of the speakers in the front speaker array 61. For example, X-Y coordinates of an image object 110 (e.g., lightning in this example) shown on the screen 55 in FIG. 3A can be mapped to individual speakers of the front speaker array 61 as shown by mapping 110' in FIG. 3B. According to aspects of the invention, the sound processor 60 sends control signals to the individual speakers in the front speaker array 61 that intersect the mapping 110' to play the portion of the audio signal that corresponds to the image object 110. In this manner, the sound that corresponds to the image object 110 is emanated by the individual speakers that are directly behind the location where the image object 110 appears on the screen 55.

Still referring to FIGS. 3A and 3B, in embodiments, the other speakers of the front speaker array 61 that do not intersect the mapping 110' are controlled to not play the portion of the audio signal that corresponds to the image object 110. These other speakers may be controlled to play other portions of the audio component of the source signal. For example, one or more of the speakers that do not intersect the mapping 110' may be controlled by the sound processor 60 to play a remainder of the audio component of the source signal concurrently while the speakers that do intersect the mapping 110' play the audio portion that corresponds to the image object 110.

In embodiments, data that defines the mapping 110' is encoded in the source signal and decoded by the decoder module 85 of the sound processor 60 while the video is playing. For example, for each frame of the video, the source signal may include encoded data that defines the X-Y coordinates of the mapping 110' and a portion of the audio component that corresponds to the mapping 110'. As the image object 110 moves location in the displayed video from one frame to the next, the mapping 110' may also change to follow the location of the image object 110. In this manner, the image object may 110 may move across the screen 55 in a sequence of frames of the video, and the individual speakers of the front speaker array 61 are controlled to cause the emanated sound to dynamically follow the movement of the image object 110 based on the mapping 100' changing from frame to frame of the video. For example, the video that is projected on the screen 55 may include an image of a car moving from left to right across the screen 55, and the sounds of the car engine and/or tires may be played by only the individual speakers of the front speaker array 61 that coincide with the location of the image of the car as the image of the car moves across the screen 55.

In situations when data defining the mapping is not encoded in the source signal, the analyzer module 90 may be configured to analyze the video stream of the source signal to identify predefined image objects to track. The predefined image objects can be specified in the source signal or dynamically by a user. For example, in a video stream of an action movie, the system can track the position of an explosion using image analysis. The analyzer module 90 simultaneously processes the audio track and isolates sounds associated with the image object being tracked (e.g., the explosion in this example). Plural different sound signatures may be stored in an audio database and associated with the predefined image objects for performing this analysis. For example the sound of an explosion is associated with the explosion image object being tracked by image analysis. When the audio track contains a sound matching the tracked image object (e.g., the explosion is shown on the screen 55), this portion of the audio is isolated and played from the speaker(s) corresponding to X-Y location where the image object appears on the screen 55.

FIG. 4 shows a plan view of an exemplary implementation of a system that plays sounds encoded with a location in a three dimensional coordinate system to provide depth control of sounds in a direction orthogonal to the screen. In embodiments, the front speaker array 61 behind the screen 55 extends in the X direction and the Y direction (into the page), and in which left and right speaker arrays 62 and 63 extend in the Z direction that is orthogonal to the screen 55 and the X and Y directions.

As shown in FIG. 4, the left speaker array 62 includes speakers 62.1, 62.2, . . . , 62.*p*, each of which is controllable by the sound processor 60 independently of the other speakers in the array 62. Similarly, the right speaker array 63 includes speakers 63.1, 63.2, . . . , 63.*q*, each of which is controllable by the sound processor 60 independently of the other speakers in the array 63. The numbers "p" and "q" may be any desired integers.

In accordance with aspects of the invention, the source signal (e.g., from source device 65) may be encoded such that a sound associated with an image object (e.g., image object 110 projected onto the screen 55) is encoded with X-Y-Z location data. In embodiments, the decoder 85 of the sound processor 60 decodes the X-Y-Z location data associated with the sound, and provides appropriate signals to play the sound at by least one speaker of the front speaker array 61 corresponding to the X-Y location of the X-Y-Z location, and by at least one of speaker of the left array 62 and the right array 63 corresponding to the Z location of the X-Y-Z location.

FIG. 4 illustrates the emanation of three sound samples 401, 402, 403. Each sample emanates at an X-Y location behind viewing screen 55, and emanates out to a point in the room in the Z direction. As sounds emanate out over time, speakers in the side arrays 62 and 62 will broadcast the sounds to enhance the movement of the sound to the audience. In this example, the line 404 represents the movement of an image object moving left to right on the screen, with a desire for the sound of the object to move deeper into the room in the Z direction. To achieve the desired sound of the image object moving in the Z direction, the system controls the left and right arrays 62 and 63 to emit sound from the appropriate speakers along the Z direction to gain perceived depth (e.g., speakers at the front of the arrays 62, 63 are fired first, then as the object moves back speakers further back in the arrays 62, 63 are fired).

For example, sound sample 401 may have an encoded X-Y-Z location of 0-0-5, such that the sound processor causes sound sample 401 to be output by a first speaker in array 61, speaker 62.1 in array 62, and speaker 63.1 in array 63. Sound sample 402 may have an encoded X-Y-Z location of 60-70-5, such that the sound processor causes sound sample 401 to be output by a second speaker in array 61, speaker 62.1 in array 62, and speaker 63.1 in array 63. And sound sample 403 may have an encoded X-Y-Z location of 50-50-50, such that the sound processor causes sound sample 401 to be output by a third speaker in array 61, speaker 62.5 in array 62, and speaker 63.5 in array 63. In this example, the sounds 401 and 402 emanate out a short distance in the Z direction, while the sound 403 emanates out about two-thirds the depth of the room in the Z direction. In this manner, the user hears the sounds emanating from both front and side, but phasing of the sounds allows the sounds to mix at the user's ears and appear positioned in the space of the room. Phasing provides the illusion of where the sound is in the room to the listener. In this example, the sound sample 401 appears on the far left, and the sound sample 402 appears further to the right. To achieve the desired sound location that is perceived by the user, differing levels of audio are emitted from the two speakers on the speaker arrays 62 and 63 along the walls and one speaker in the array 61 behind the screen, effectively firing at different levels of loudness. The result is phasing in which the sounds to mix at the user's ears and appear positioned in the space of the room.

Figure 5:
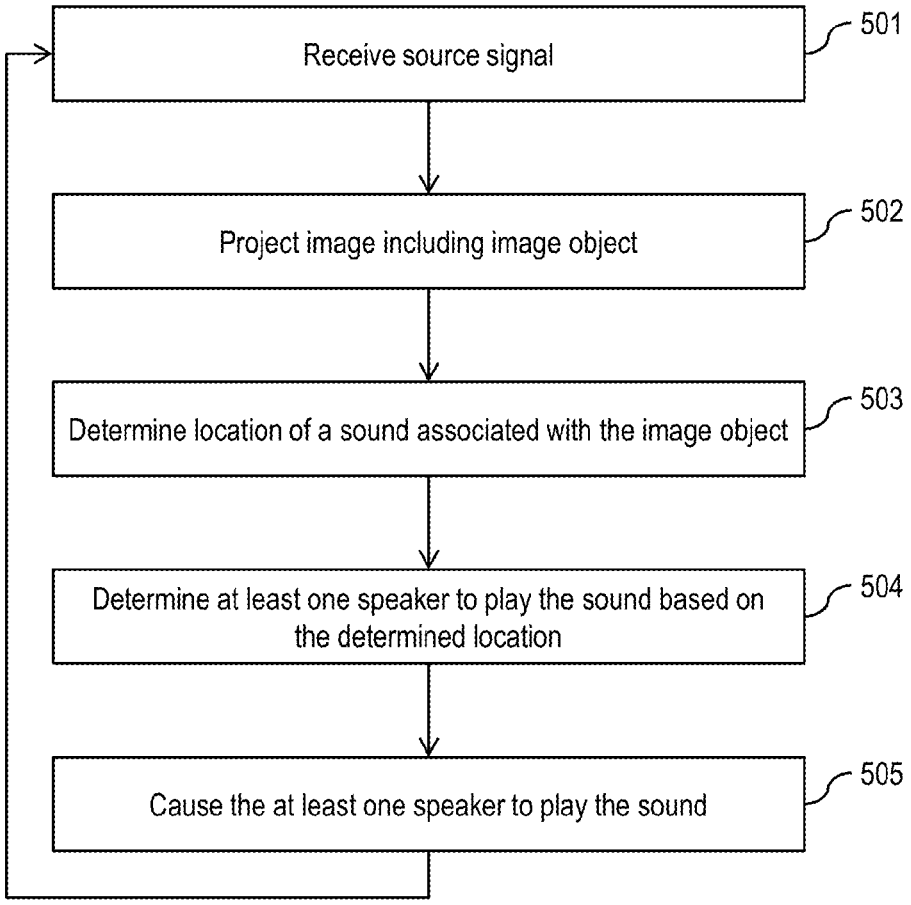
FIG. 5 shows a flowchart of a method in accordance with aspects of the invention.

FIG. 5 shows a flowchart of a method in accordance with aspects of the invention. Steps of the method of FIG. 5 may be performed in the environments illustrated in FIGS. 2-4, and are described with reference to elements shown in FIGS. 2-4.

At step 501, a source signal is received by a projector and/or a sound processor (e.g., projector 50 and/or sound processor 60 of FIG. 2). In embodiments, the source signal comprises a video component and an audio component. Both components may be provided to each of the projector and/or a sound processor. Alternatively, the video component may be provided solely to the projector and the sound component may be provided solely to the sound processor.

At step 502, the projector projects an image onto a screen based on the video component of the source signal. The projected image may comprise an image object (e.g., image object 110 as in FIG. 3A) at a particular location on the screen. For example, the image may be the entire image projected onto the screen, and the image object may be a portion of less than the entire image.

At step 503, the sound processor determines a location of a sound associated with the image object from step 510. In an embodiment, the location of the sound comprises an X-Y location that is determined either by: decoding encoded data in the source signal, or real time image and audio analysis of the video and audio components of the source signal. The decoding and real time analysis may be performed in the manner described with respect to FIGS. 3A and 3B. In another embodiment, the location of the sound comprises an X-Y-Z location that is determined by decoding encoded data in the source signal, e.g., in the manner described with respect to FIG. 4.

At step 504, the sound processor determines at least one speaker to play the sound based on the determined location from step 515. In embodiments, the sound processor maps the X-Y location of the sound to a front speaker array (e.g., front speaker array 61) and determines individual speaker(s) of the array that intersect the mapped location (e.g., as illustrated in FIG. 3B). In embodiments where the location of the sound comprises an X-Y-Z location, the sound processor additionally determines one or more speakers in the left speaker array 62 and the right speaker array 63 that correspond in location to the Z coordinate of the determined X-Y-Z location, e.g., as described with respect to FIG. 4.

At step 505, the sound processor causes the at least one speaker (determined at step 520) to play the sound. In embodiments, the sound processor sends an audio signal to the determined at least one speaker. The audio signal may be amplified by or more power amplifiers between the sound processor and the speakers.

As described herein, the steps 501-505 may be performed for a first frame of the video contained in the source signal. The step 501-505 may be repeated for a second frame of the video, and then repeated again for a third frame, and so on. In this manner, the system may cause the sound associated with an image object to move from one speaker to the next as the image object moves across the screen.

In embodiments, a service provider, such as a Solution Integrator, could offer to perform the processes described herein. In this case, the service provider can create, maintain, deploy, support, etc., the computer infrastructure that performs the process steps of the invention for one or more customers. These customers may be, for example, any business that uses technology. In return, the service provider can receive payment from the customer(s) under a subscription and/or fee agreement and/or the service provider can receive payment from the sale of advertising content to one or more third parties.

In still another embodiment, the invention provides a computer-implemented method for performing one or more of the processes herein on a network. In this case, a computer infrastructure, such as computer system 12 (FIG. 1), can be provided and one or more systems for performing the processes of the invention can be obtained (e.g., created, purchased, used, modified, etc.) and deployed to the computer infrastructure. To this extent, the deployment of a system can comprise one or more of: (1) installing program code on a computing device, such as computer system 12 (as shown in FIG. 1), from a computer-readable medium; (2) adding one or more computing devices to the computer infrastructure; and (3) incorporating and/or modifying one or more existing systems of the computer infrastructure to enable the computer infrastructure to perform the processes of the invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method comprising:

determining, by a computing device, an X-Y-Z location of a sound associated with an image object projected on a screen;

determining, by a computing device, a front speaker of a front speaker array based on an X-Y coordinate of the X-Y-Z location;

determining, by a computing device, at least one side speaker of a left speaker array and a right speaker array based on a Z coordinate of the X-Y-Z location, wherein the left speaker array and the right speaker array are on a side of the screen opposite the front speaker array; and causing, by a computing device, the front speaker and the at least one side speaker to emit the sound.

2. The method of claim 1, wherein the causing the front speaker and the at least one side speaker to emit the sound comprises transmitting respective control signals to the front speaker and the at least one side speaker.

3. The method of claim 1, wherein:

the front speaker array is behind the screen; and the screen is acoustically transparent.

4. The method of claim 3, wherein:

an X dimension of the front speaker array is the same as an X dimension of the screen; and an Y dimension of the front speaker array is the same as an Y dimension of the screen.

5. The method of claim 3, wherein an X-Y coordinate of the front speaker corresponds to an X-Y coordinate of the image object projected on a screen.

6. The method of claim 1, further comprising:

determining a second X-Y-Z location of a second sound associated with the image object projected on the screen at a second location;

determining, a second front speaker of the front speaker array based on an X-Y coordinate of the second X-Y-Z location;

determining a second at least one side speaker of the left speaker array and the right speaker array based on a Z coordinate of the second X-Y-Z location; and causing the second front speaker and the second at least one side speaker to emit the second sound.

7. The method of claim 1, wherein the determining the X-Y-Z location of the sound comprises decoding data that is encoded in a source signal.

8. The method of claim 1, further comprising causing other speakers of at least one of the front speaker array, the left speaker array, and the right speaker array to emit other sounds simultaneously with the front speaker and the at least one side speaker to emitting the sound.

9. A system, comprising:

an acoustically transparent screen;

a projector configured to project video onto the screen;

a front speaker array behind the screen;

a left speaker array extending orthogonal to the front speaker array and the screen;

a right speaker array extending orthogonal to the front speaker array and the screen; and a sound processor that is configured to cause a speaker in the front speaker array, a speaker in the left speaker array, and a speaker in the right speaker array to emit a sound based on a location of an image object projected on the screen by the projector, wherein the sound processor is configured to:

determine an X-Y-Z location of the sound;

determine the speaker in the front speaker array based on an X-Y coordinate of the X-Y-Z location of the sound; and determine the speaker in the left speaker array and the speaker in the right speaker array based on a Z coordinate of the X-Y-Z location of the sound.

10. The system of claim 9, wherein the determining the X-Y-Z location of the sound comprises decoding data that is encoded in a source signal.

11. The system of claim 9, wherein:

an X dimension of the front speaker array is the same as an X dimension of the screen; and an Y dimension of the front speaker array is the same as an Y dimension of the screen.

12. The system of claim 9, wherein the speaker in the front speaker array is directly behind the image object projected on the screen by the projector.

13. The system of claim 9, wherein:

the sound processor is configured to cause a second speaker in the front speaker array, a second speaker in the left speaker array, and a second speaker in the right speaker array to emit a second sound based on a second location of the image object projected on the screen;

the location of the image object projected on the screen comprises a first location at a first time;

the second location is at a second time after the first time; and the second location is different than the first location.

14. The system of claim 9, wherein the sound processor and the projector are integrated in a single device.

15. The system of claim 9, wherein the front speaker array comprises plural rows and plural columns of speakers.

16. The system of claim 15, wherein the sound processor is configured to control each individual speaker of the front speaker array independently of the other speakers of the front speaker array.

17. The system of claim 9, further comprising an analyzer module that is configured to determine an X-Y location of a sound associated with a projected image object by:

analyzing a video component of a source signal, using image analysis, to identify a predefined object; and analyzing an audio component of the source signal to identify a sound associated with the identified object.

18. A computer program product for audio control, the computer program product comprising a computer readable storage medium having program instructions embodied therewith, the program instructions executable by a computing device to cause the computing device to:

receive a source signal;

determine a location of a sound associated with an image object projected on a screen based on the source signal;

determine at least one speaker to play the sound; and transmit a signal to the at least one speaker to play the sound, wherein the determining the location of the sound comprises one of:

determining an X-Y-Z location of the sound by decoding data encoded in the source signal; and determining an X-Y location of a sound associated with a projected image object by: analyzing a video component of a source signal, using image analysis, to identify a predefined object; and analyzing an audio component of the source signal to identify a sound associated with the identified object.

19. The computer program product of claim 18, wherein the computer readable storage medium is a storage device.

* * * * *